US006127918A

United States Patent [19]

Lin

[11] Patent Number: 6,127,918

[45] Date of Patent: Oct. 3, 2000

[54] BUZZER WITH A SOUND FILM AND EQUALIZING OR WHIRLPOOL SOUND MECHANISM

[76] Inventor: Kuang-yao Lin, No. 5 Lane 110, Wei Kuo Street, Tainan, Taiwan

[21] Appl. No.: 09/320,248

[22] Filed: May 26, 1999

[51] Int. Cl.[7] ..... G10K 9/00

[52] U.S. Cl. ..... 340/388.1; 340/384.1; 340/311.1; 340/407.1; 340/391.1; 381/340; 381/341; 381/342; 381/343

[58] Field of Search ..... 340/388.1, 384.1, 340/311.1, 407.1, 391.1; 381/340, 341, 342, 343, 386, 396

[56] References Cited

U.S. PATENT DOCUMENTS 3,942,029 3/1976 Kawakami et al. ..... 307/88 ET
4,378,471 3/1983 Shintaku ..... 179/119 R
4,392,747 7/1983 Kumada et al. ..... 368/88
4,439,640 3/1984 Takaya ..... 179/110
5,742,696 4/1998 Walton ..... 381/156

*Primary Examiner*—Jeffery A. Hofsass
*Assistant Examiner*—Hung Nguyen
*Attorney, Agent, or Firm*—Pro-Techtor International Services

[57] ABSTRACT

A buzzer includes a base with an upper opening, a vibrating plate fixed on the upper opening of the base, a sound film fixed flatly on the vibrating plate, and an equalizing or whirlpool sound mechanism for transmitting the sound produced by the vibrating plate to enhance dB of medium and high sound of a wide range and to reach far. Thus the buzzer has overwhelming sounding effect and sweet tone.

4 Claims, 5 Drawing Sheets

BUZZER WITH A SOUND FILM AND EQUALIZING OR WHIRLPOOL SOUND MECHANISM

BACKGROUND OF THE INVENTION

This invention relates to a buzzer, particularly to one possible to give out high and medium range of sounds in an overwhelming and far-reaching manner.

A conventional buzzer shown in FIG. 1, is what is called a coil moving buzzer, including a base 10, a T-shaped core 11 fixed inside the base 10, a magnet 12 surrounding the core 11, and a washer 13 on the magnet 12, a sound film 14 above the core 11, and an equalizing sound mechanism 15 on the sound film 14. Further, a coil 16 is fitted in a gap between the sound film 14 and the T-shaped core 11 together with the washer 13. Then the coil 16 may be attracted to or repelled off by the permanent magnet formed by the T-shaped core and the washer 13 when the coil 16 is electrified and magnetic force is produced. Therefore, the sound film 14 may vibrate by the magnetic force to produce sound, which is then spread out around with the sounding mechanism 15. However, this conventional coil moving buzzer depends on the sound film 14 vibrated by the magnet 12 and the T-shaped core 11, which has to have a large size to cause heavy weight, not easy to carry. Thus conventional vibrating buzzers have been devised to be rather light.

A first conventional vibrating buzzer 2 shown in FIG. 2, includes a base 20, a vibrating plate 21 consisting of a copper plate 210 and a ceramic plate 211, and a sounding mechanism 22 fixed above the vibrating plate 21. When the vibrating plate 21 is electrified, it vibrates up and down to give out sound, which is then transmitted and dispersed out and around. The vibrating plate 21 is then and very light, made of copper and and ceramic, improved in the weight much lighter than the conventional coil moving buzzer mentioned above. Nevertheless, sound given out by the vibrating plate is not intensified auxiliary by a sound film, but directly transmitted and dispersed with the sounding mechanism 22. So sound volume, dB (decibel), and sound range are still small, substantially including high shrill sound only, devoid of medium sound range, with weak sound transmitting force impossible to reach far.

Another conventional vibrating buzzer shown in FIG. 3, includes a vibrating plate 30, a funnel-shaped sound film 31 additionally fixed on the outer edge of the vibrating plate 30, which has its outer edge connected to the mouth edge of the base 32 for intensifying sound produced by the vibrating plate 30. However, the sound film 31 is connected to the outer edge of the vibrating plate 30 with a "line" only, resulting in poor mutual vibration together. In other words, the sound film 31 is in no position to intensify much the sound produced by the vibrating plate 30. Therefore, the sound given out by this conventional buzzer is still weak, shrill and a small range.

SUMMARY OF THE INVENTION

The main objective of the invention is to offer a buzzer having large dB of wide range of medium and high sound to give out an overwhelming and pleasing sound.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
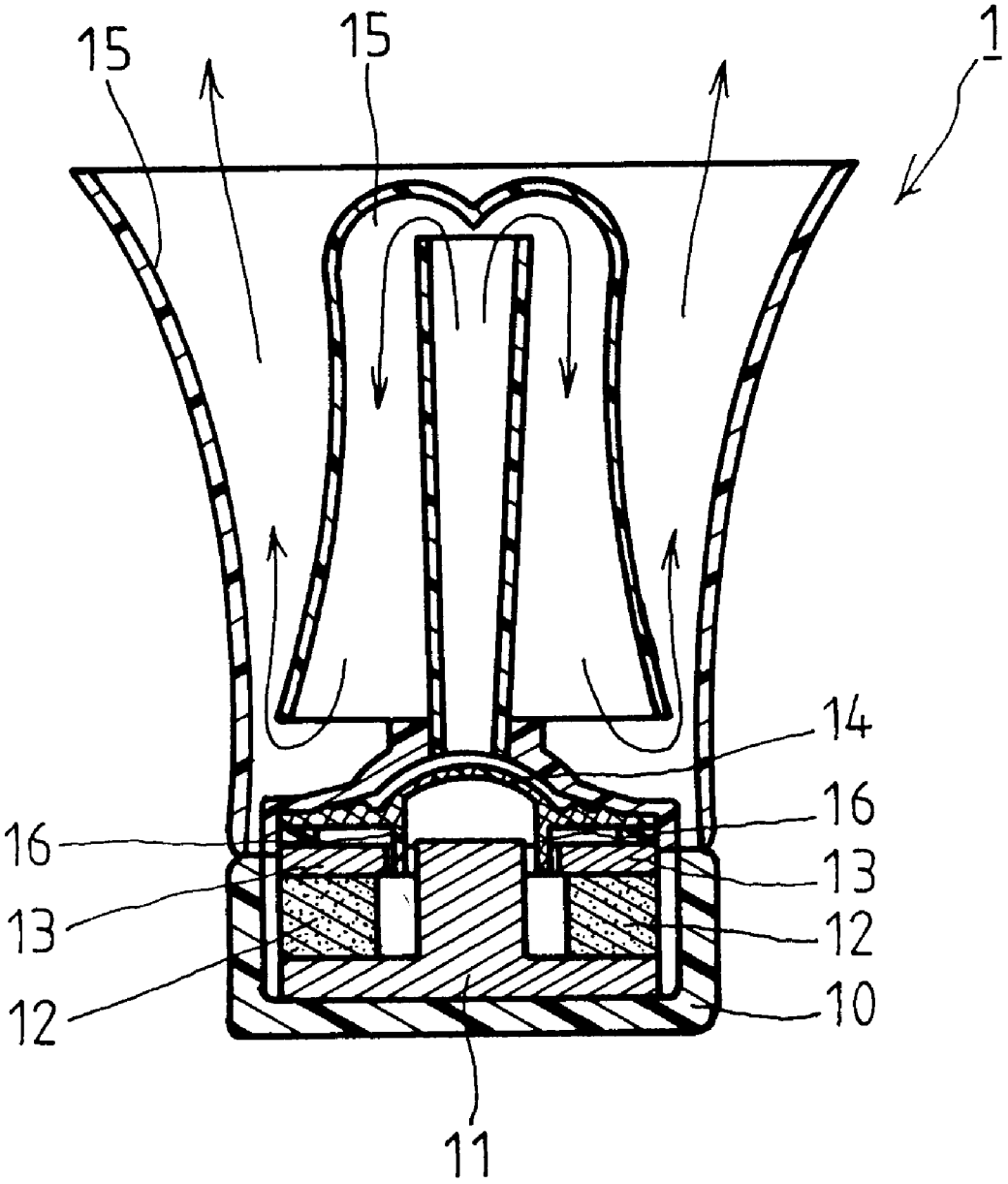
FIG. 1 (PRIOR ART)
FIG. 1 is a cross-sectional view of a conventional coil moving buzzer.
Figure 2:
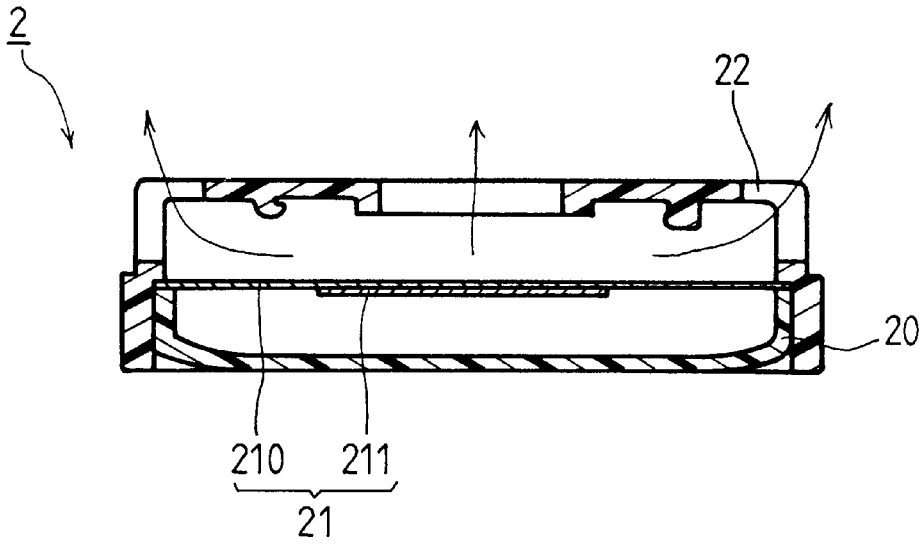
FIG. 2(PRIOR ART)
FIG. 2 is a cross-sectional view of a first conventional vibrating plate buzzer.
Figure 3:
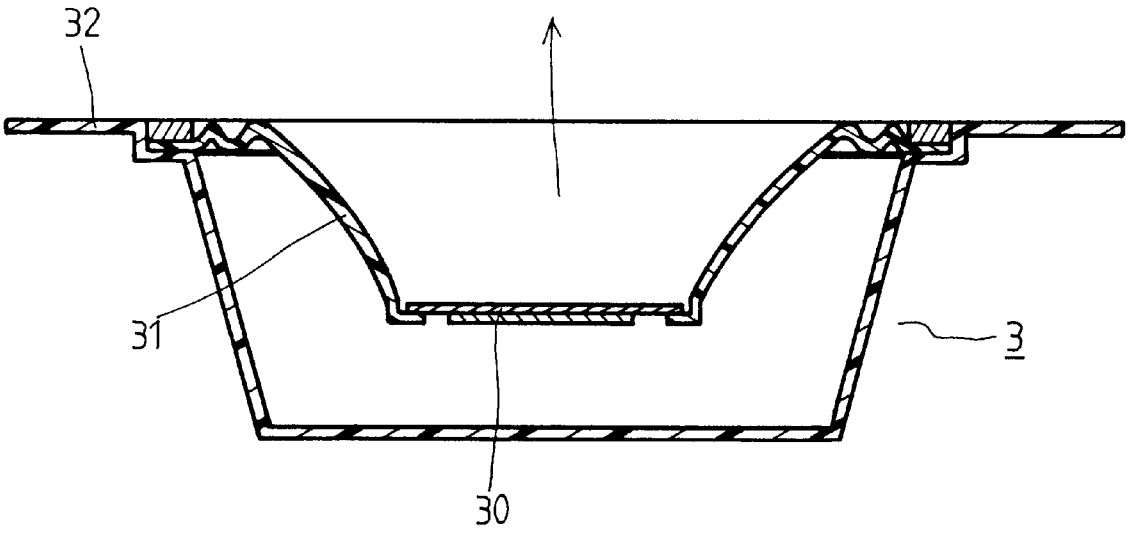
FIG. 3(PRIOR ART)
FIG. 3 is a cross-sectional view of a second conventional vibrating plate buzzer.
Figure 4:
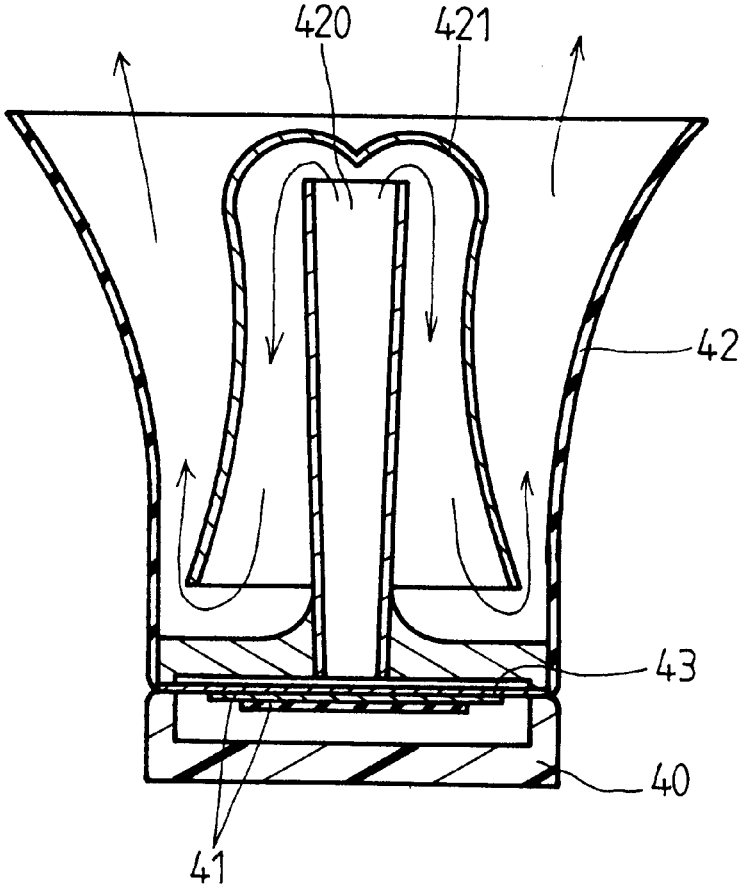
FIG. 4 is a cross-sectional view of a first embodiment of a buzzer in the present invention.
Figure 5:
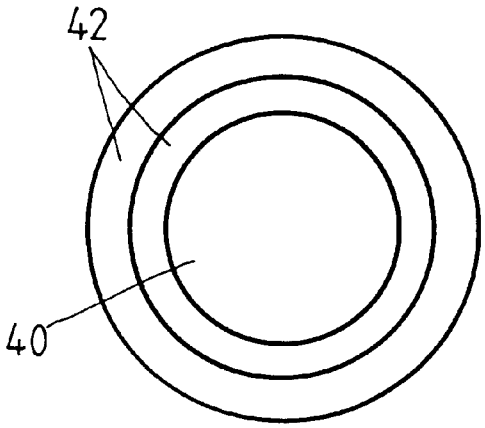
FIG. 5 is an upper view of the first embodiment of a buzzer in the present invention.

A first embodiment of a buzzer in the present invention, as shown in FIGS. 4 and 5, includes a base 40 having an upper opening, a vibrating plate 41 fixed on the upper opening of the base 40 and having a copper plate and a ceramic plate of a smaller size than the copper plate fixed under the copper plate to vibrate up up and down to produce sound when electrified, a sound film 43 attached on the vibrating plate 41 and having its outer edge fixed with the opening edge of the base 40 to intensifying sound the vibrating plate 41 produces, and an equalizing sounding mechanism 42 fixed on vibrating plate 41 for transmitting the sound produced by the vibrating plate 41.

The equalizing sounding mechanism 42 has tapered tubular sound exit 420 standing upright on the sound film 43 for transmitting the sound produced by the vibrating plate, and an inverted cup-shaped upper cap 421 covering on and around the tubular sound exit 420 to guide the sound move down first and then up as shown by the arrow heads in FIG. 4. This is the feature of an equalizing sound mechanism.

In the first improved embodiment of a buzzer, the sound film 43 is fixed on the vibrating plate 41 by means of surface connection, which may enhance effect of synchronous vibration of the vibrating plate 41 and the sound film 43, with the sound film intensifying the sound produced by the vibration plate 41. Then the equalizing sound mechanism 42 cooperates to enhance dB of wide range of medium and high sound, permitting the sound to spread farther, obtaining overwhelming sounding effect and sweet pleasing sound.

Figure 6:
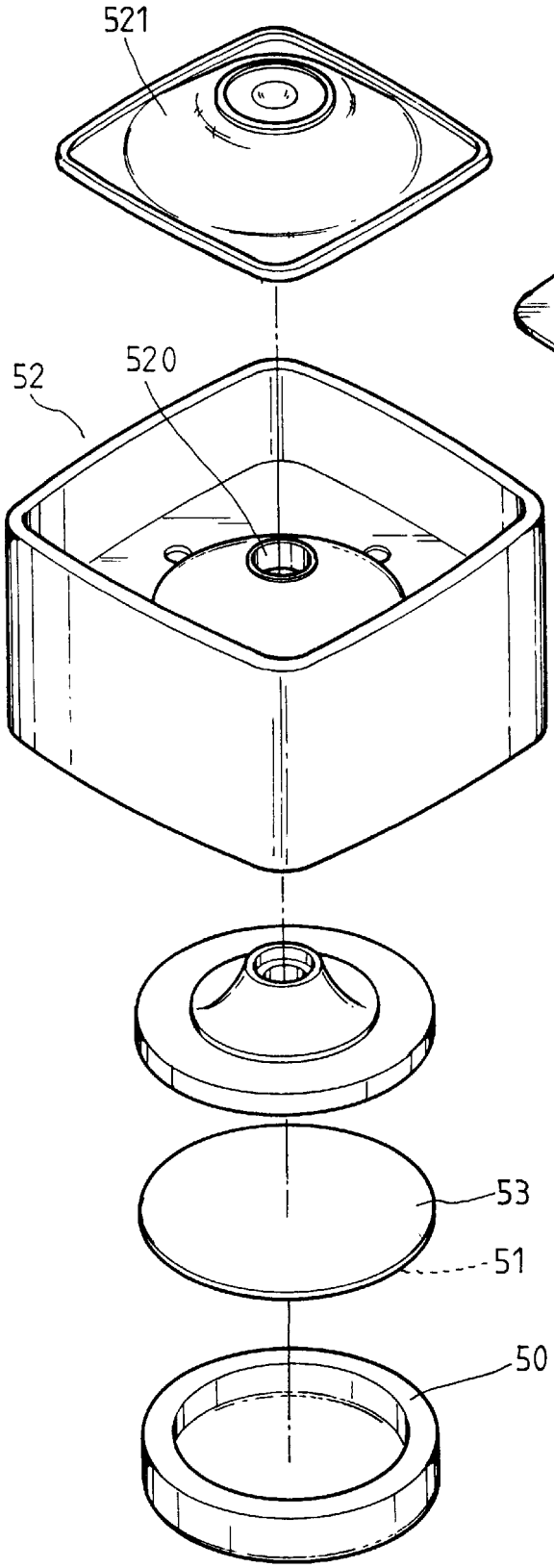
FIG. 6 is an exploded perspective view of a second embodiment of a buzzer in the present invention.
Figure 7:
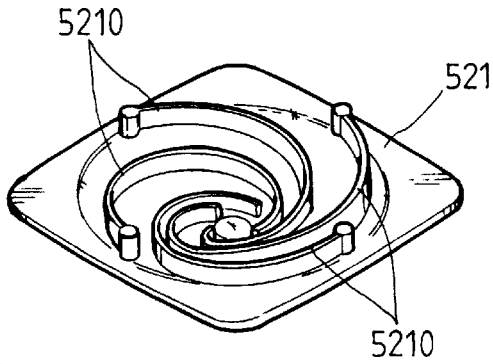
FIG. 7 is an inverted perspective view of an upper cap in FIG. 6.
Figure 8:
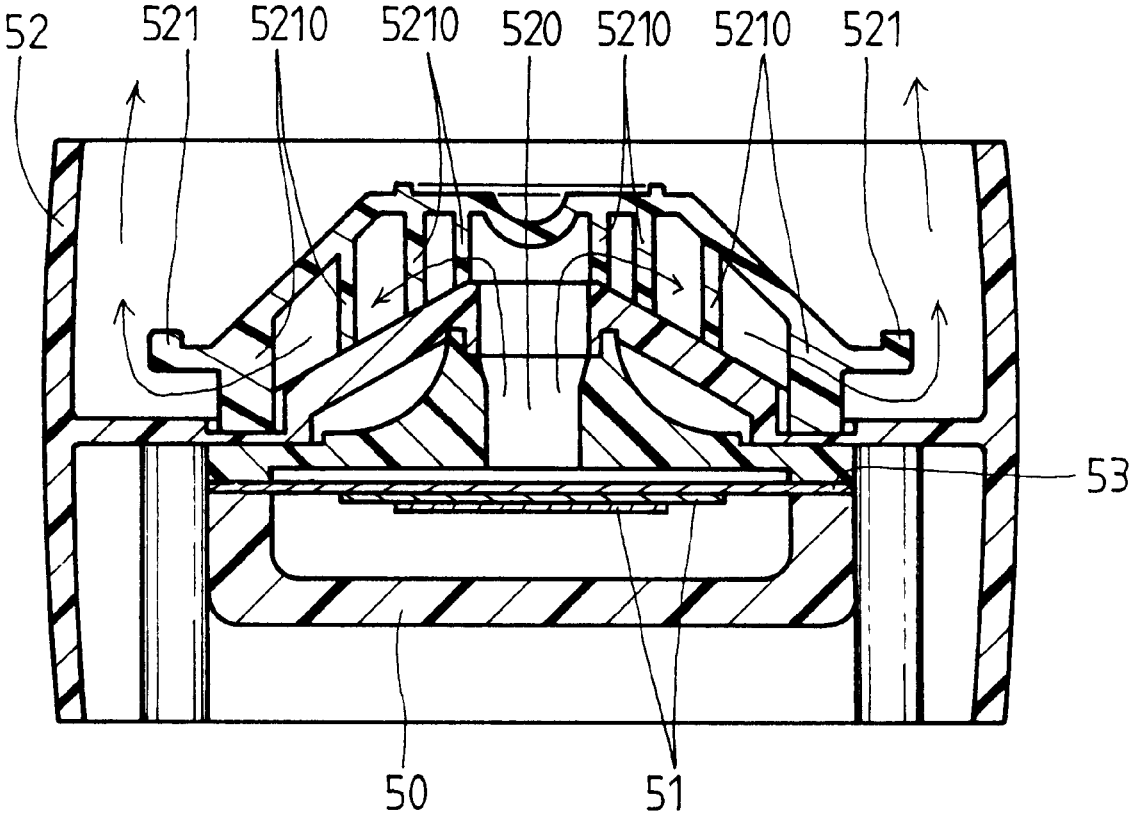
FIG. 8 is a cross-sectional view of the second embodiment of a buzzer in the present invention.

Next, FIGS. 6 and 8 show a second embodiment of a buzzer in the invention, so called a whirlpool buzzer, including a base 50 having an upper opening, a vibrating plate 51 fixed on the upper opening of the base 50 to vibrate to five out sound when it is electrified, a sound mechanism 52 having a whirlpool shape and fixed on the vibrating plate 51. Further, a sound film 53 is attached on the vibrating plate 51. The sound mechanism 52 has a sound exit 520, and an upper cap 521 closing on the sound mechanism 52 and having plural spiral sound guiding walls 5210 fixed on a lower surface of the upper cap 521, as shown in FIG. 7. Thus, the sound coming from the vibrating plate 51 passes through the sound exit 520 and through the spiral guiding wall to spread out in the air.

In the invention, the sound film directly fixed on the vibrating plate in a flat surface can vibrate together with the vibrating plate to intensify the sound produced by the vibrate plate, cooperated by the spiral sound mechanism to enhance dB of medium and high sound to permit the sound spread far and wide. Therefore, the buzzer in the invention has overwhelming sounding effect and sweet tone.

While the preferred embodiments of the invention have been described above, it will be recognized and understood that various modifications may be made therein and the appended claims are intended to cover all such modifications which may fall within the spirit and scope of the invention.

I claim:

1. A buzzer comprising:

a vibrating plate of a flat surface to vibrate to produce sound when it is electrified;

a sound film fixed directly and flatly on and vibrating together with said vibrating plate;

an equalizing or whirlpool sound mechanism deposited on said sound film;

the sound produced by said vibrating plate is intensified by said sound film and transmitted by said sound mechanism, which enhances sound volume, especially those of medium and high sound.

2. The buzzer as claimed in claim 1, wherein said sound film is adhered with said vibrating plate.

3. The buzzer as claimed in claim 1, wherein said equalizing sound mechanism has a tapered tubular sound exit, and an inverted cup-shaped upper cap closing and surrounding said tapered tubular sound exit, said upper cap spaced apart from said sound exit with an aperture.

4. The buzzer as claimed in claim 1, wherein said whirlpool sound mechanism has an upper cap on said sound exit, and plural spiral sound guiding walls formed on a lower surface of said upper cap.

* * * * *